United States Patent [19]

Holmes

[11] 4,072,354

[45] Feb. 7, 1978

[54] BREAKER APPARATUS

[75] Inventor: John Holmes, Richmond, Canada

[73] Assignee: William Machinery Limited, Richmond, Canada

[21] Appl. No.: 683,812

[22] Filed: May 6, 1976

[51] Int. Cl.[2] ..... F23J 1/06

[52] U.S. Cl. ..... 299/37; 173/28; 299/70

[58] Field of Search ..... 299/37, 36, 38, 70; 173/28, 43, 38

[56] References Cited

U.S. PATENT DOCUMENTS

| | | | |
|---|---|---|---|
| 2,423,787 | 7/1947 | Mosena et al. | 299/37 |
| 3,346,300 | 10/1967 | Grant | 173/43 X |
| 3,773,118 | 11/1973 | Shanks | 173/43 |
| 3,905,647 | 9/1975 | Alfarnes et al. | 173/43 |

FOREIGN PATENT DOCUMENTS

| | | | |
|---|---|---|---|
| 486,631 | 4/1970 | Germany | 173/43 |
| 111,036 | 4/1967 | Norway | 173/43 |
| 930,621 | 7/1963 | United Kingdom | 173/43 |

*Primary Examiner*—Ernest R. Purser
*Assistant Examiner*—William F. Pate, III
*Attorney, Agent, or Firm*—Larson, Taylor and Hinds

[57] ABSTRACT

Apparatus including a downwardly-extending breaker bar connected for vertical movement by linkage to a base adapted to be mounted on a suitable traction unit. A hydraulic cylinder unit extends between the base and the breaker bar, and operating means is associated with the cylinder unit for selectively supplying fluid to said unit alternatively to raise and lower the breaker bar to cause it to strike a surface to be broken, such as the crust that forms on aluminum smelt in pots during the electrolytic production of aluminum.

10 Claims, 6 Drawing Figures

BREAKER APPARATUS

This invention relates to apparatus particularly designed for breaking crust which forms on the surface of molten aluminum in the production pots thereof, but which may be used for other breaking purposes.

For the sake of convenience, this invention will be described in connection with the breaking of crusts on electrolytic baths in pots during the production of aluminum. This crust forms continuously and must be periodically broken up and pushed into the molten material to be melted with it. This breaking of the crust has been done in the past by hand, but it was a slow and dangerous operation.

The prior art includes apparatus for breaking these crusts, such apparatus being exemplified by U.S Pat. No. 3,819,144, dated June 25, 1974. The apparatus of this patent and other similar apparatus utilize pneumatic hammers for breaking the crust. Such hammers require large volumes of air under pressure and, as a result, the systems employing these hammers necessitate hoses extending to an air supply system provided in the building in which the aluminum pots are located. These hoses have to be dragged behind the vehicle upon which the crust breaker is mounted, thereby limiting the mobility of the vehicle and creating dangerous conditions for men working around the pots, and result in costly maintenance of the hoses.

On the other hand, the breaker apparatus of the present invention is a completely self-contained unit. It includes a heavy vertically arranged breaker bar which is rapidly moved up and down by a hydraulic cylinder unit during the breaking operation. The breaker bar is mounted so that it can be swung from side to side of the traction unit upon which the apparatus is mounted so as to reach pots on both sides of the traction unit. The bar is lifted out of the way by the cylinder unit when it is not required, and is lowered into operating position by this unit when it is required to break crust in an aluminum pot. The actual reciprocation of the breaker bar can be controlled manually, or it can be controlled automatically by suitable cycling apparatus.

Breaker apparatus according to the present invention comprises a base adapted to be mounted on a traction unit, an elongated heavy breaker bar having at a lower end a breaker point, linkage swingably mounting the breaker bar on the base for substantially vertical movement, said linkage maintaining the breaker bar in a downwardly-extending attitude, a hydraulic cylinder unit extending between and connected at opposite ends to the base and the breaker bar, and operating means for selectively supplying pressure fluid to said cylinder unit alternatively to raise and lower said breaker bar to cause said point thereof to strike surface crusts and the like therebeneath.

Figure 1:
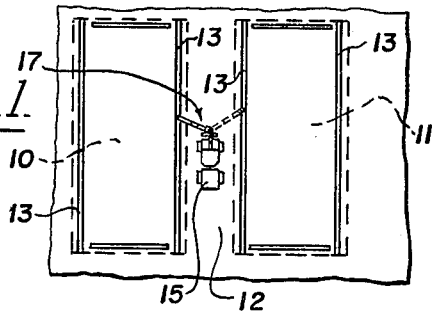
Figure 2:
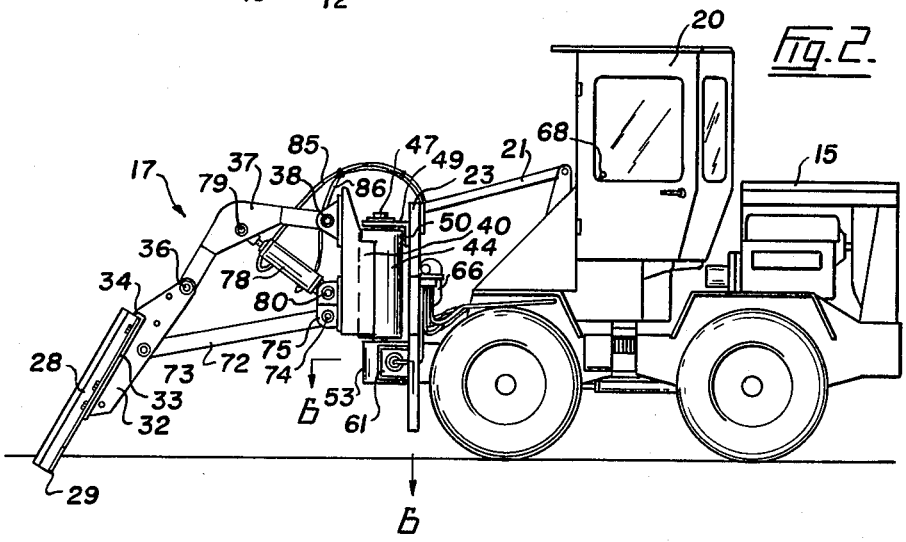
Figure 3:
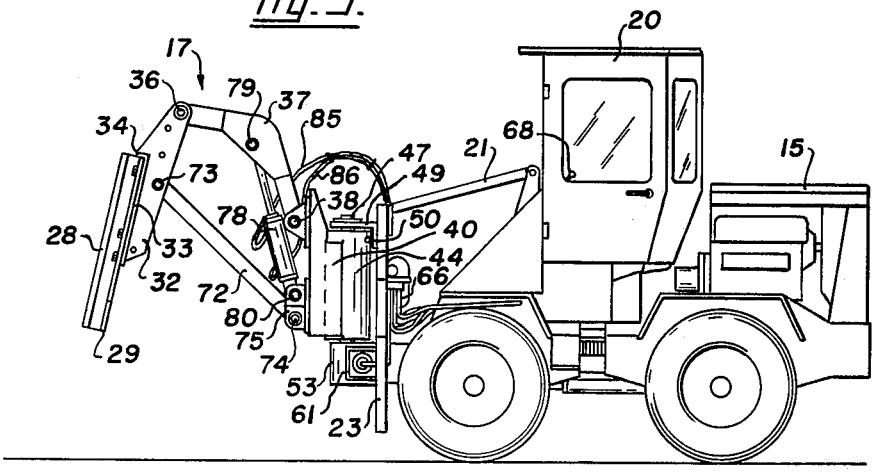
Figure 4:
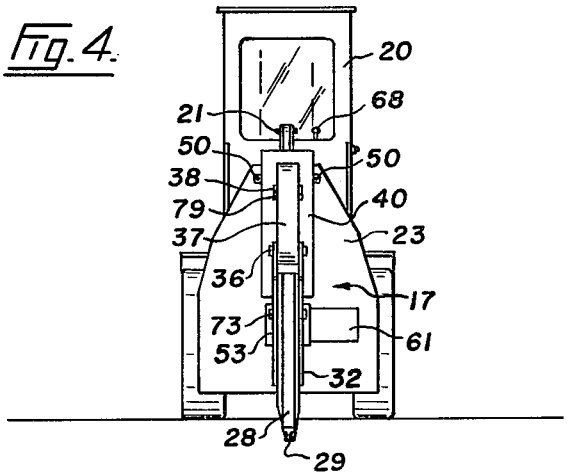
Figure 5:
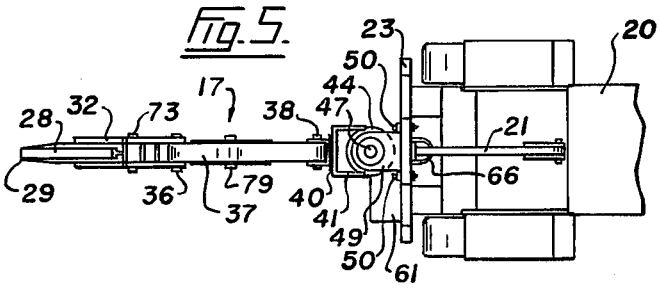
Figure 6:
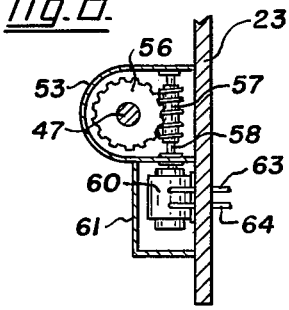

A preferred form of this invention is illustrated by way of example in the accompanying drawings, in which:

FIG. 1 is a diagrammatic plan view of two parallel aluminum-producing pots with a traction unit carrying the present breaker apparatus in the aisle between the pots, FIG. 2 is a side elevation of a traction unit with the present breaker apparatus mounted thereon, this apparatus being shown in the operating position, FIG. 3 is a view similar to FIG. 2 but showing the breaker apparatus in the elevated or inoperative position, FIG. 4 is a front elevation of the apparatus shown in FIG. 2, FIG. 5 is a plan view of the apparatus of FIG. 2, and FIG. 6 is an enlarged horizontal section taken on the line 6—6 of FIG. 2.

Referring to FIG. 1 of the drawings, 10 and 11 are two pots in a production line having an aisle 12 therebetween. These pots are covered by a super structure 12 having slots 13 therein through which the materials used in the production of aluminum are directed into the pots, and molten aluminum is withdrawn therefrom. The crust that requires breaking forms beneath these slots.

A traction unit 15 is shown in aisle 12 with breaker apparatus 17 in accordance with this invention mounted on the front end thereof. This apparatus has a breaker point which can be directed into slots 13 and reciprocated vertically to break the crusts therebeneath.

The breaker apparatus 17 is illustrated in detail in FIGS. 2 to 6. In this example, the traction unit 15 has an air conditioned cab 20 and a framework 21 mounted on its forward end for carrying the breaker apparatus 17. The framework 21 includes a vertical mounting plate 23 which extends across the front end of traction unit 15.

Breaker apparatus 17 includes a breaker bar 28 which extends generally in a vertical direction. This bar has a breaker point 29 on its lower end. Bar 28 is mounted on a beam 32 which extends generally in the same direction as the bar. The bar is bolted or otherwise fastened in notch 33 formed in beam 32, and a brace or backing plate 34 mounted on the beam bears against the upper end of bar 28 to brace the latter. The bar 28 and the beam 32 form a breaker unit, bar 28 being an easily replaceable tip for this unit.

The upper end of beam 32 is connected by a pivot pin 36 to an outer end of an arch-shaped link 37, the opposite end of which is pivotally connected by pin 38 to a vertical mount 40 which is of generally U shape as indicated at 41 in FIG. 5. The mount 40 embraces and is secured to a column 44 of substantially circular cross section which, in turn, is fixedly mounted on a shaft 47 which extends therethrough and beyond its upper and lower ends. The mount 40 and column 44 constitute a mounting base for the breaker unit. The upper end of shaft 47 is journalled in a bracket 49 secured to mounting plate 23 by bolts 50. The lower end of shaft 47 extends through another bracket 53 carried by mounting plate 23.

A worm gear 56 is fixedly mounted on shaft 47 within bracket 53, see FIG. 6, and meshes with a worm drive 57 on a shaft 58 which extends at right angles to shaft 47 and is coupled to a reversible hydraulic motor 60 mounted on plate 23 within a cover 61. Pressure hoses 63 and 64 extend from motor 62 to a hydraulic system 66 mounted on plate 23. This is a standard hydraulic system and is adapted to direct pressure fluid to motor 60 selectively to drive it in opposite directions. The control for this system may be a valve actuated by a lever 68 is cab 20.

A connecting link 72 is swingably mounted at an outer end by a pin 73 to beam 32 of the breaker unit, and is swingably mounted by a pin 74 at its inner end on a bracket 75 carried by and secured to mount 40. An extensible hydraulic unit 78 has its opposite ends connected to link 37 and bracket 75 by pins 79 and 80, respectively. Actually, links 37 and 72 form linkage swingably mounting breaker bar 28 for substantially vertical movement. As hydraulic unit 78 extends between mount 40 and upper link 37, extension of said unit raises the breaker bar, while retraction of the unit moves the breaker bar downwardly. Hydraulic unit 78 is connected by hoses 85 and 86 to the hydraulic system 66. The control for cylinder unit 78 may be a lever-operated valve, not shown, in cab 20 so that the operator of unit 15 completely controls the vertical movement of the breaker bar. On the other hand, the hydraulic control system may be such that the operator can move the breaker bar between its lower operative position as shown in FIG. 2 and its upper inoperative position as shown in FIG. 3. In the latter case, an automatic cycling control may be provided for raising and lowering the breaker bar a limited distance while it is in its operative position to cause the bar to strike the crust in an aluminum-producing pot. As these hydraulic control system are well known in the field, it is not necessary to describe and illustrate them herein.

The operation of the breaker apparatus 17 is very simple. When it is desired to start to break the crust in a given pot, such as pot 10, apparatus 17 is moved into position by traction unit 15 while the breaker apparatus is in the inoperative position shown in FIG. 3. The operator then causes the hydraulic system to energize the motor 60 to swing the breaker bar right or left of the traction unit. In FIG. 1, the breaker apparatus has been swung to the left of the traction unit and into position with the breaker bar positioned above the adjacent slot 13. The operator then causes cylinder unit 78 to be energized to lower the breaker bar of the breaker unit through the slot into the operative position shown in FIG. 2. The apparatus is now ready to start the breaking operation.

The operator can manipulate the controls to cause the breaker bar or unit to be raised and lowered rapidly a limited distance so that breaker point 29 breaks the crust on the molten material in the pot to break the crust and to disperse it in the molten metal. On the other hand, if automatic controls are provided, the operator would set these into operation so that the breaker bar or unit is automatically reciprocated to break the crust. The speed of reciprocation can be as desired, and eighty cycles per minute have been found suitable for this purpose. As the breaker bar is being reciprocated, traction unit 15 can be moved to shift the bar along the slot 13 in which it is operating.

During the breaking operation, breaker bar 28 is subjected to relatively great strain. This bar is both strong and heavy, and the brace plate 34 braces the upper end of the bar during this operation. This brace plate also relieves the strain on the bolts which removably secure the breaker bar to beam 32. If the breaker bar is damaged or becomes worn it can readily be removed from the beam and repaired or a new bar can be installed.

I claim:

1. Breaker apparatus for breaking surface crusts and the like, comprising a base adapted to be mounted on a traction unit, an elongate passive, non-pneumatic breaker bar unit comprising an elongated, fixedly mounted breaker bar having a breaker point at a lower end thereof, linkage swingably mounting the breaker bar unit on the base for substantially vertical movement, said linkage maintaining the breaker bar unit in a generally downwardly-extending attitude and comprising vertically spaced upper and lower links pivotally connected at opposite ends to the base and the breaker bar unit, a single hydraulic cylinder unit having a lower end connected to the base and an upper end connected to the upper link, and operating means for selectively supplying pressure fluid to said cylinder unit alternatively to swing the upper link up and down and consequently to raise the lower said breaker bar unit to cause said point thereof to strike surface crusts and the like therebeneath and, together with said single hydraulic cylinder unit, constituting the sole means for the said raising and lowering of said breaker bar unit.

2. Breaker apparatus as claimed in claim 1 including pivot means for swingably mounting said base on a traction unit, and power means connected to the base operable to swing said base and consequently said breaker bar unit laterally into different positions with respect to the base.

3. Breaker apparatus as claimed in claim 1 in which said upper link is arch shaped with one end pivotally connected to an upper end of the breaker bar unit and an opposite end pivotally connected to the base, said cylinder unit being connected to the upper link substantially midway between the ends thereof.

4. Breaker apparatus as claimed in claim 3 in which said lower link has an end pivotally connected to and base and an opposite end pivotally connected to the breaker bar unit at a point spaced from said one end of the upper link.

5. Breaker apparatus as claimed in claim 1 in which said breaker bar unit comprises a downwardly-extending beam, and a breaker bar mounted on and extending longitudinally of and below a lower end of said beam, said linkage being pivotally connected to the beam.

6. Breaker apparatus as claimed in claim 5 including bracing means fixedly mounted on the beam and engaging an upper end of the breaker bar to brace the latter.

7. Breaker apparatus for breaking surface crusts and the like, comprising a vertical shaft mountable for rotation on a traction unit, a vertical mounting base secured to the shaft to rotate therewith, power means connected to the shaft operable to rotate said shaft, and elongated breaker unit having at a lower end a breaker point, substantially parallel upper and lower links having vertically spaced inner ends pivotally connected to the base and vertically spaced outer ends pivotally connected to the breaker bar unit, said upper and lower links swingably mounting the breaker bar unit on the base for substantially vertical movement and maintaining said bar unit in a generally downwardly-extending attitude, a single hydraulic cylinder unit having a lower end connected to the base and an upper end connected to the upper link, and operating means for selectively supplying pressure fluid to said cylinder unit alternatively to swing the upper link up and down and consequently to raise and lower said breaker bar unit to cause said point thereof to strike surface crusts and the like therebeneath and, together with said single hydraulic cylinder, constituting the sole means for the said raising the lowering of said breaker bar unit.

8. Breaker apparatus as claimed in claim 7 in which said upper link is substantially arch shaped, and said cylinder unit is connected to the upper link substantially midway between the ends thereof.

9. Breaker apparatus as claimed in claim 7 in which said breaker bar unit comprises a downwardly-extending beam, and a breaker bar mounted on and extending longitudinally of and below a lower end of said beam, said linkage being pivotally connected to the beam.

10. Breaker apparatus as claimed in claim 9 including bracing means fixedly mounted on the beam and engaging an upper end of the breaker bar to brace the latter.

* * * * *